US006560881B2

(12) United States Patent
Coffin

(10) Patent No.: US 6,560,881 B2
(45) Date of Patent: May 13, 2003

(54) SHAVING RAZOR WITH PIVOTING BLADE CARRIER AND REPLACEABLE BLADE CARTRIDGE THEREFOR

(75) Inventor: David C. Coffin, Milford, CT (US)

(73) Assignee: Warner-Lambert Company, Morris Plains, NJ (US)

( * ) Notice: Subject to any disclaimer, the term of this patent is extended or adjusted under 35 U.S.C. 154(b) by 142 days.

(21) Appl. No.: 09/796,129

(22) Filed: Feb. 28, 2001

(65) Prior Publication Data

US 2002/0116832 A1 Aug. 29, 2002

(51) Int. Cl.[7] ..... B26B 21/52
(52) U.S. Cl. ..... 30/531; 30/50
(58) Field of Search ..... 30/527, 530, 531, 30/532, 47, 50

(56) References Cited

U.S. PATENT DOCUMENTS 3,938,247 A 2/1976 Carbonell et al. ..... 30/47
4,198,746 A 4/1980 Trotta ..... 30/47
4,492,024 A * 1/1985 Jacobson ..... 30/47

* cited by examiner

*Primary Examiner*—Douglas D. Watts
(74) *Attorney, Agent, or Firm*—Peter C. Richardson; Gregg C. Benson; Raymond D. Thompson

(57) ABSTRACT

A shaving razor has a blade carrier, which may be part of a replaceable blade cartridge, pivotally supported by a main component or handle assembly, the main component and the blade carrier having cooperating convex and concave arcuate bearing surfaces whereby the carrier is movable about the pivot axis by sliding movement of the convex and concave bearing surfaces over one another, and a spring mechanism both holds the convex and concave bearing surfaces in engagement with one another and resiliently biases the carrier in one direction about the pivot axis toward a limit position.

23 Claims, 5 Drawing Sheets

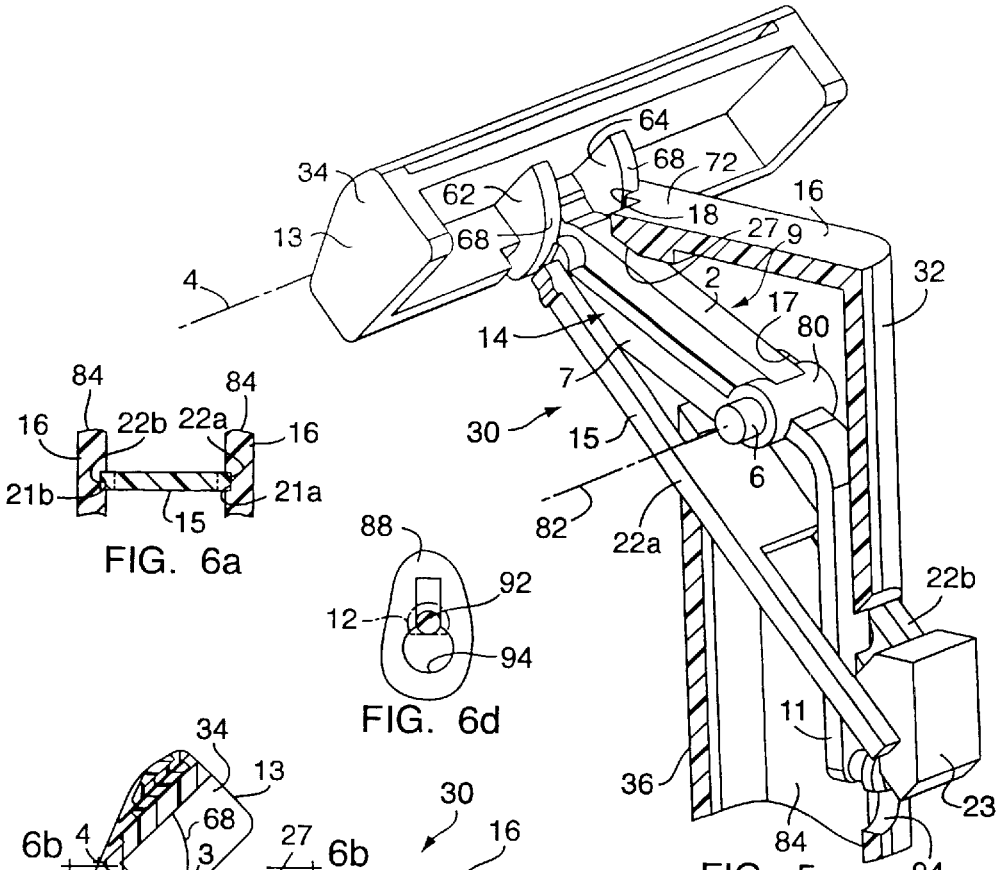
FIG. 5
FIG. 6a
FIG. 6d
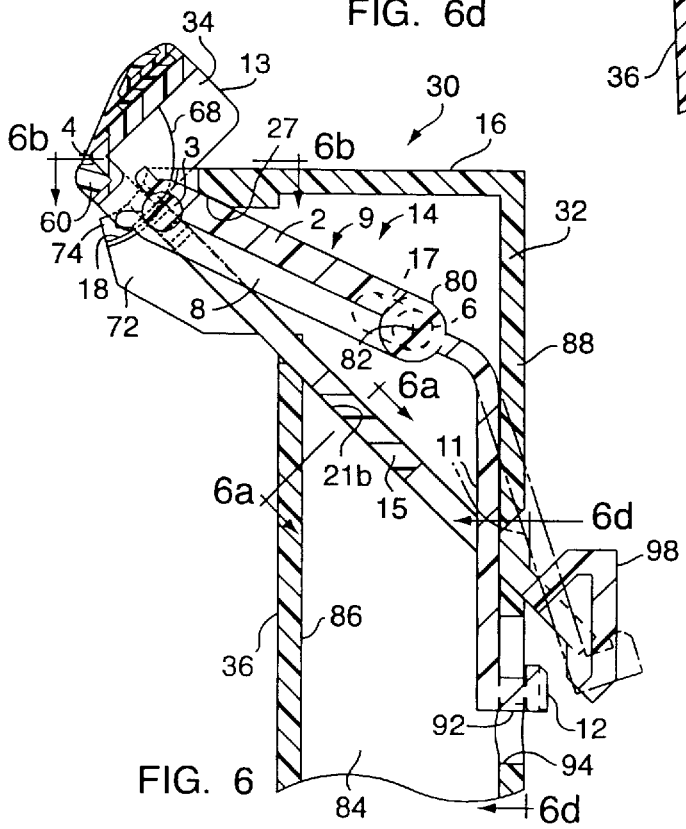
FIG. 6
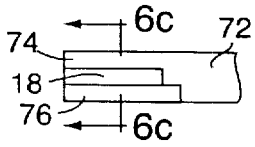
FIG. 6b
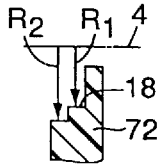
FIG. 6c

SHAVING RAZOR WITH PIVOTING BLADE CARRIER AND REPLACEABLE BLADE CARTRIDGE THEREFOR

FIELD OF THE INVENTION

This invention concerns a shaving razor having a main component or handle assembly pivotally carrying a blade carrier carrying one or more blades with elongated cutting edges, and deals more particularly with improvements in the pivotal connection between the main component and the blade carrier, in a mechanism for spring biasing the blade carrier in its pivotal movement relative to the main component, and in a replaceable blade cartridge which includes the blade carrier and the one or more blades.

FIELD OF THE INVENTION

In the case of shaving razors with pivotal blade carriers, it is known to achieve the pivotal support for the carrier through the use of cooperating arcuate surfaces on the blade carrier and on the main component or handle assembly. An example of such known razor is described in U.S. Pat. No. 6,138,361 to Richard et al. In this Richard et al. razor, the blade carrier at each of its ends is pivotally connected with the handle assembly by a laterally inwardly extending projection having concentric radially inner and outer arcuate surfaces, and which projection is received in an arcuately shaped groove of the handle assembly, with radially inner and outer surfaces of the groove capturing the projection and restraining it to generally pivotal movement relative to the handle assembly. The connection between the blade carrier and the handle assembly is, however, a relatively loose one and no biasing forces are applied to the blade carrier to overcome the looseness in the connection between the carrier and the handle assembly or to urge the carrier to some limit position and to resiliently resist its movement away from such limit position. Also, the structure of the pivotal connection is one which does not easily lend itself to having the blade carrier be part of a replaceable blade cartridge.

The general object of the invention is, therefore, to provide a shaving razor with a pivotal blade carrier wherein the structure of the connection between the pivotal blade carrier and the main component or handle assembly is of a low cost simple construction, which results in the blade carrier being firmly held without looseness to the main component, which provides for the blade carrier being spring biased in its movement about the pivot axis relative to the main component, which allows the blade carrier to be easily made as part of an expendable cartridge replaceable with respect to the main component, and which allows the use of a simple mechanism for ejecting a used blade cartridge from the main component.

Other objects and advantages of the invention will be apparent from the following detailed description of a preferred embodiment of the invention and from the accompanying drawings and claims.

BRIEF DESCRIPTION OF THE DRAWINGS

The drawings are:

FIG. 5—A perspective view of a shaving razor embodying the invention and using the blade carrier of FIG. 1 and the spring element of FIG. 3, with some parts of the razor being shown broken away to reveal the structure of other parts, the blade cartridge being shown in a counterclockwise limited position.

FIG. 6—A vertical sectional view of the shaving razor of FIG. 5.

FIG. 6*a*—A fragmentary sectional view taken on the line 6*a*—6*a* of FIG. 6.

FIG. 6*b*—A plan view of one side arm of the upper portion of the main component of the shaving razor of FIG. 6 and taken generally on the line 6*b*—6*b* of FIG. 6 with the blade cartridge removed.

FIG. 6*c*—A vertical sectional view taken on the line 6*c*—6*c* of FIG. 6*b*.

FIG. 6*d*—A view taken on the line 6*d*—6*d* of FIG. 6.

DETAILED DESCRIPTION OF THE PREFERRED EMBODIMENT

Figure 1:
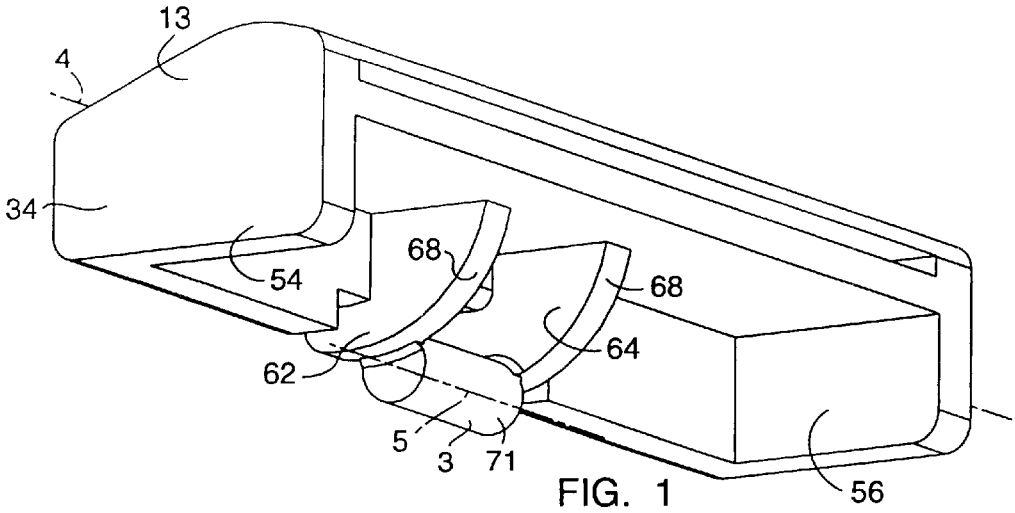
FIG. 1—A perspective view of a blade cartridge made in accordance with the invention.

Referring first to FIG. 5, a shaving razor embodying the invention is there shown generally at 30 and is comprised basically of a main component or handle assembly 32, a blade carrier 34, which is pivotal relative to the main component 32 about a horizontal pivot axis 4, and a blade mechanism for both firmly holding the blade carrier 34 to the main component 34 and for biasing the blade carrier 34 relative to the main component 32 in one direction about the pivot axis 4, with that direction being the counterclockwise direction as seen in FIGS. 5 and 6. The main component 32 includes an upper portion 16 in the form of a hollow housing which transitions downwardly into a lower portion 36 which may itself constitute a handle or which is fixed to a separate handle. The spring mechanism may take various different forms without departing from the broader aspects of the invention, and may consist of an assembly of a number of separate parts. Preferably, however, and as shown in the illustrated embodiment, the spring mechanism is comprised of a one-piece spring element 14 as described in more detail hereinafter. The blade carrier 34 may be permanently assembled with the main component 32, with the entire razor 30 being disposable after the blade or blades of the blade carrier have been worn to an unsatisfactory degree of performance. However, preferably, and as shown in the figures, the blade carrier 34 and its blade or blades are part of a cartridge 13 which is replaceably insertable into and removable from the main component 32 to allow continued use of the main component 32 with a large number of successively replaced blade cartridges.

Figure 2:
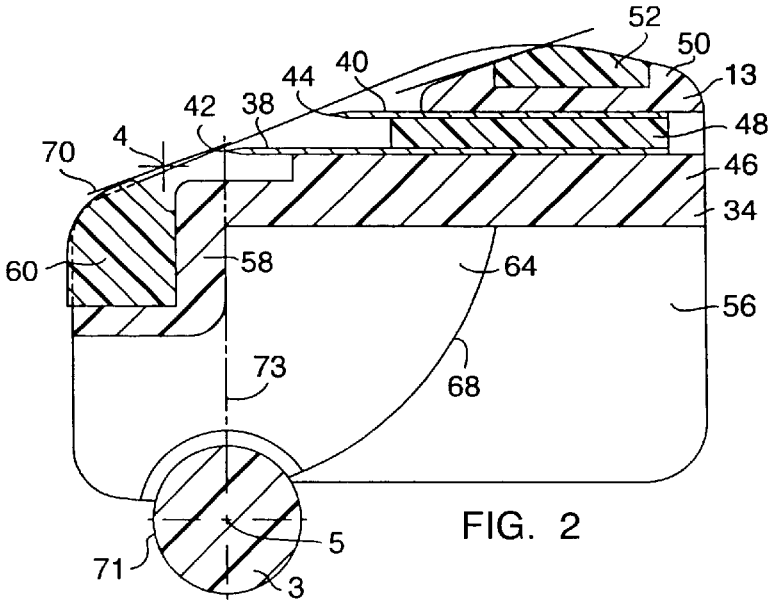
FIG. 2—A vertical sectional view taken through the cartridge of FIG. 1.

Referring to FIGS. 1 and 2, the blade cartridge 13 includes the blade carrier 34 which may be made as a plastic insert molded part or as an assembly of laminated plastic pieces. As shown in FIG. 2, the carrier 34 includes lower and upper horizontal metal blades 38 and 40 having elongated straight cutting edges 42 and 44, respectively. The lower blade 38 rests on a seat portion 46 of the carrier, the two blades are vertically separated from one another by a spacer plate 48, and the upper blade 40 is covered and held in place by a cap 50 carrying a shaving aid 52. At the ends of the carrier 34 are side walls 54 and 56. The seat portion 34, spacer 48 and cap 50 extend horizontally between the side walls 54 and 56, and at the forward edge of the seat portion 34 is a stepped front wall portion 58 carrying a guard element 60, the front wall 58 and guard element 60 also extending between the side walls 54 and 56.

To enable a pivotal connection of the cartridge 13 to the main component 32, and as seen best in FIG. 1, the carrier 34 also includes two protrusions 62 and 64 having convex arcuate bearing surfaces 68,68 concentric to the horizontal axis 4 which extends parallel to the cutting edge 42 of the lower blade 38 and which, as shown, is located slightly forwardly of the cutting edge 42 and approximately on a line 70 tangent to the guard 60 and cap 50. The two protrusions 62 and 64 are spaced from one another along the length of the axis 4 and are symmetrically located equal distances from the longitudinal mid-point of the cartridge.

For the purpose of connecting the cartridge 13 to other parts of the spring mechanism, as described in more detail hereinafter, the carrier 34 of the cartridge 13 also includes a pickup element in the form of a pickup bar 3 extending between the protrusions 62 and 64 having a cylindrical outer surface 71 extending a full 360° about a horizontal axis 5 extending parallel to the cutting edge 42 and pivot axis 4 and located a substantial distance below the cutting edge 42 and in or near the vertical plane 73 containing the cutting edge 42.

Turning to FIGS. 5 and 6, both of these figures show the shaving razor 30 in a fully assembled condition with the main component 32 carrying an inserted replaceable blade cartridge 13. In each figure the cartridge 13 is in a forward limit position at which it is held by an arm 9 of the spring element 14 with the arm 9 acting against a stop surface 27 on the upper portion 16 of the main component 32.

For receiving and holding the blade cartridge 13, the upper portion 16 of the main component 32 has two leftwardly extending arms 72, only one of which is shown in the figures, with each arm 72 having a concave arcuate bearing surface 18 which is complementary to the associated arcuate bearing surface 68 of the blade cartridge 13, so that the two bearing surfaces 18 of the main component receive and engage the complementary bearing surfaces 68 of the carrier 34, so that the blade cartridge can pivot relative to the main component about the pivot axis 4 by arcuate sliding movement of the bearing surfaces 68 over the bearing surfaces 18. To longitudinally center the cartridge 13 relative to the main component 32, the side arms 72 of the main component each have a vertical wall 74 located outboard of the associated arcuate bearing surface 18, which wall 74 is engageable with the associated protrusion 62 or 64 of the cartridge 13 to restrain the cartridge against longitudinal movement in one direction, the two side walls 74 of the main component thereby together restraining longitudinal movement of the blade cartridge in opposite directions to keep it longitudinally centered on the main component 32.

Preferably, and as shown in FIGS. 6*b* and 6*c*, each side arm 72 is substantially thicker in width than the width of the bearing surface 18 and to keep the bearing surface 18 relatively narrow to reduce the sliding friction between it and the associated bearing surface 68 of the blade cartridge, each arm 72 also includes a relief surface 76 which is also concentric to the axis 4 but of a slightly larger radius $R_2$ than the radius $R_1$ of the adjacent bearing surface 18.

The previously mentioned spring mechanism of the razor is one which cooperates with the blade carrier 34 by grasping the cylindrical portion 3 and pulling that portion generally rearwardly or to the right in FIG. 6 to bring the convex bearing surfaces 68 of the blade carrier into seated engagement with the concave bearing surfaces 18 of the main component 32 with the spring mechanism also urging the cylindrical pickup bar 3 counterclockwise about the pivot axis 4 as seen in FIG. 6. Such spring mechanism may take various different forms and may sometimes be comprised of a number of separate parts in assembly with one another, but in the preferred and illustrated case, in addition to the pickup bar 3 of the blade carrier 34, the spring mechanism is comprised essentially of a single spring element such as the spring element 14 shown best in FIGS. 3 and 4.

Figure 3:
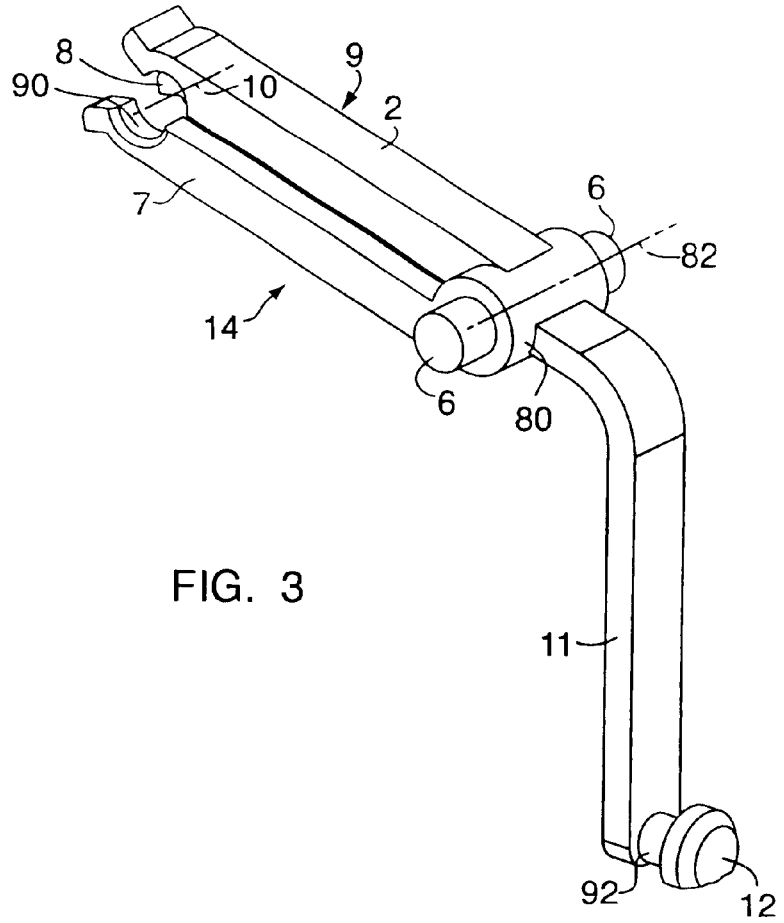
FIG. 3—A perspective view of a spring element used in the saving razor of the invention.
Figure 4:
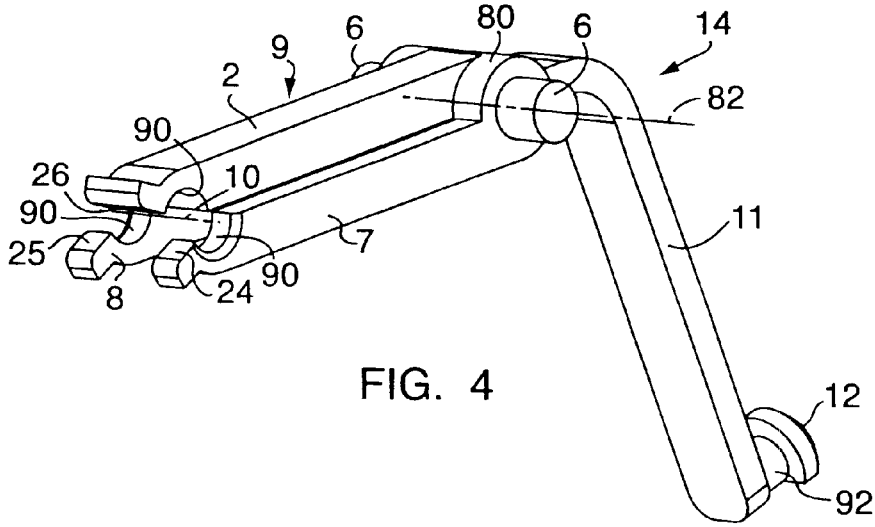
FIG. 4—A perspective view of the spring element of FIG. 3 but with the view being taken at an angle relative to the spring element different from the viewing angle of FIG. 3.

Referring to FIGS. 3 and 4 and to FIGS. 5 and 6, the spring element 14 has a central portion 80 with two oppositely extending cylindrical stubs 6, concentric to a common axis 82, which are received in two inclined slots 17 in the two side walls of the upper portion 16 of the main component 32, the upper portion 16 being hollow and formed by two side walls 84, a front wall 86 and a rear wall 88, only one of the side walls 84 and one of the slots 17 being shown in FIG. 6. The spring element 14 includes a first arm 9 which extends generally forwardly and upwardly from the center portion 80 through an opening in the front wall 86 and to the cylindrical pickup bar 3 of the blade carrier 34. As seen best in FIG. 4, the arm 9 is actually made up of three separate fingers 7, 8 and 2, with the finger 2 being opposed to the fingers 7 and 8 and with all three fingers having an arcuate cutout, complementary to the outer surface 71 of the pickup bar 3, about a common axis 10 and with each finger also having an inclined lead-in surface 24, 25 and 26, respectively. The fingers are resiliently flexible so that they can bend away from each other to the extent needed to allow the cylindrical pickup bar 3 of the blade carrier 34 to be snap fittingly pushed into assembly with the fingers 7, 8 and 2 and snappingly ejectable from the fingers 7, 8 and 2 by a force urging the pickup bar outwardly from the arm 9. The spring element 14 also has a second arm 11 which extends generally rearwardly and downwardly from the center portion 80 as shown in FIGS. 3 and 4.

The spring element 14 is made from a thermoplastic material having a high allowable strain before yield and good lubricity. Preferable materials are polyamide and polyoxymethylene. In FIGS. 3 and 4, the spring element 14 is shown in its neutral unstressed condition. Referring to FIG. 6, in the assembled condition of the spring element 14 with the main component 32, the second arm 11 of the spring element slidingly engages a stop surface of the main component 32, in this case the rear wall 88, and is held in a stressed condition by the rear wall, the broken lines in FIG. 6 showing the neutral unstressed position the arm 11 would take in the absence of the rear wall 88. Due to the arm 11 being held in the illustrated stressed condition of FIG. 6, the arm 11 urges the stubs 6 of the center portion 80 rearwardly or to the right relative to the slots 17 to the position shown in FIG. 6 and in doing so causes the arm 9 to pull the pickup part 3 of the blade cartridge to the right to hold the bearing surfaces 68 of the cartridge against the bearing surfaces 18 of the main component without any looseness appearing between the blade cartridge and the main component but with the blade cartridge nevertheless being able to pivot relative to the main component about the axis 4 by sliding movement of the cartridge bearing surfaces 68 relative to the main component bearing surfaces 18. At the same time, the stressed condition of the second arm 11, as seen in FIG. 6, biases the center portion 80 of the spring element clockwise about the axis 82 to hold the arm 9 against the stop 27. It should also be noted that the engagement of the cylindrical stubs 6 with the right-hand ends of the slots 17 defines the rightward limit of movement of the center portion 80 and the arcuate cutout surfaces 90 of the arm 9 are so located on the arm 9 that, when they snap over the pickup bar 3 of the inserted blade carrier 34, the camming action between the cutout surfaces 90 and the surface 71 of the pickup bar 3 causes the arm 9 to be pulled slightly to the left in FIG. 6 to similarly move the stubs 6 slightly away from the right-hand ends of the slots 17 to permit the rightwardly directed biasing force of the arm 11 to become effective in urging the bearing surfaces 68 of the blade carrier against the cooperating bearing surfaces 18 of the main component 32. The arm 9 may itself be designed to have a degree of springiness and to therefore with arm 11 have an effect on the biasing of the forward end of the arm 9, but preferably the arm 9 is relatively stiff in comparison to the arm 11.

Figure 7:
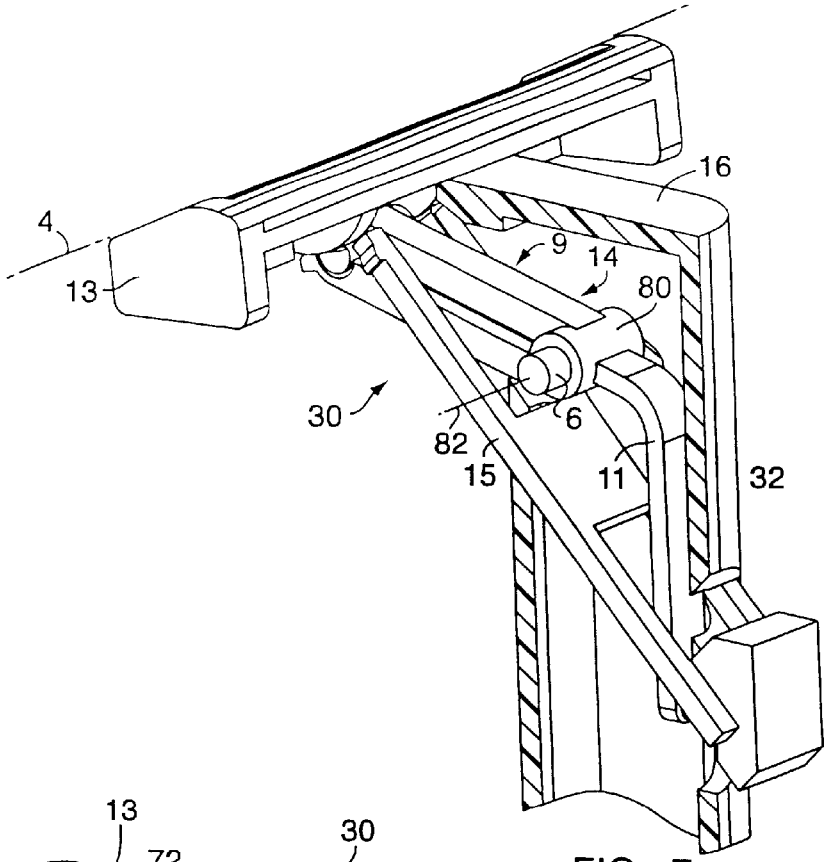
FIG. 7—A view similar to FIG. 5 but with the blade cartridge being shown in a clockwise limited position.
Figure 8:
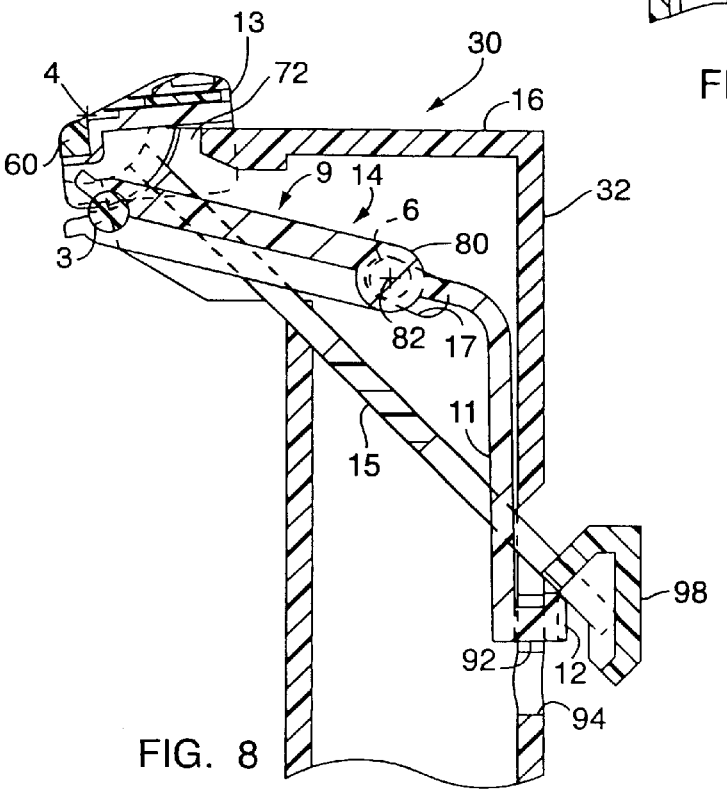
FIG. 8—A vertical sectional view taken through the shaving razor as seen in FIG. 7.

FIGS. 7 and 8 show the razor 30 with the blade cartridge 13 rotated clockwise from the FIGS. 5 and 6 positions to a clockwise limited position at which the blade cartridge is engageable with the side arms 72 of the main component 32 as seen best in FIG. 8. In the condition of FIGS. 7 and 8, the stubs 6 of the spring center portion 80 is located in the left-hand portion of the slots 17; and in the condition shown in FIGS. 7 and 8, as well as in all other conditions appearing between that of FIGS. 5 and 6 and that of FIGS. 7 and 8, the spring element 14 at all times pulls the pickup bar 3 of the cartridge 13 rearwardly, or to the right in FIG. 8, to keep the cartridge seated relative to the main component 32 and to also bias the cartridge counterclockwise about the pivot axis 4.

To stabilize the position of the spring element relative to the main component 32, the lower end of the second arm 11 of the spring element preferably includes a stem 92, having a mushroom head 12, which extends through a keyhole slot 94 in the rear wall 88 of the main component 32 as seen in FIG. 6*d*.

A feature of the above-described construction of the shaving razor 30 is that the replaceable cartridge 13 can be easily ejected from the razor by applying an outwardly directed pushing force to the pickup bar 3 of the cartridge when the cartridge is in the limit position of FIG. 6. Various suitable mechanisms may be used for applying such an ejecting force to the pickup bar 3, and in the illustrated and preferred embodiment, this ejection mechanism comprises an elongated ejector member 15 which, as shown best in FIG. 6, is received in the hollow space of the upper portion 16 of the main member 32 and is positioned so as to be inclined upwardly and forwardly from the rear wall 88. The member 15 is further slidingly supported by the side walls 84 of the upper portion 16 by grooves 21*a* and 21*b* in the side walls which receive corresponding longitudinal edge portions 22*a* and 22*b* of the ejector member 15 as seen in FIG. 6*a*. When the ejector member 15 is in the rearward position shown in FIG. 6 and the blade cartridge 13 is in the neutral position shown in FIG. 6, the upper forward end of the ejector member is located close to and rearwardly of the pickup bar 3, and from this position, the member 15, by applying thumb or finger pressure to the rear end 98 of the member 3, can be pushed forwardly or to the left in FIG. 6 to engage the pickup bar 18 and to snappingly eject it from the fingers 7, 8 and 2 of the spring arm 9. If desired, an additional spring component (not shown) may be added between the ejector member 15 and the main component 32 to restore the ejector member to its rearward or FIG. 6 position.

Although the spring mechanism of the razor may be comprised of an assembly of parts, by providing such mechanism as basically a one-piece member (the spring element 14), the manufacture of the razor is very much simplified in that the spring element can be made in one operation and can be easily and quickly assembled with the other parts of the main component of the razor. Further, the cartridge mounting parts in the form of the protrusions 62 and 64 are relatively larger than usually found on replaceable blade cartridges. Thus, visual recognition by the user is improved to improve the overall cartridge insertion function.

In the embodiment of the invention shown by FIGS. 1–8, the spring mechanism which biases the blade cartridge or other blade receiver about its pivot axis relative to the main component biases the blade carrier to a given fixed limit position and resiliently resists pivotal movement of the blade carrier away in one direction from that one given position. The invention is not, in its broader aspects, however limited to such operation of the spring mechanism and instead, if desired, the spring mechanism may be designed so that the blade carrier or cartridge is biased by the spring mechanism to a given neutral position with the spring mechanism then resiliently resisting pivotal movement of the blade receiver relative to the main component in either direction about the related pivot axis from that given position. By way of example, a shaving razor having such a spring mechanism is shown by FIGS. 9 and 10 wherein parts of the illustrated razor generally similar to corresponding parts of the razor of FIGS. 1–8 have been given the same reference numbers as in FIGS. 1–8, except for being primed, and need not be further described in detail.

Figure 9:
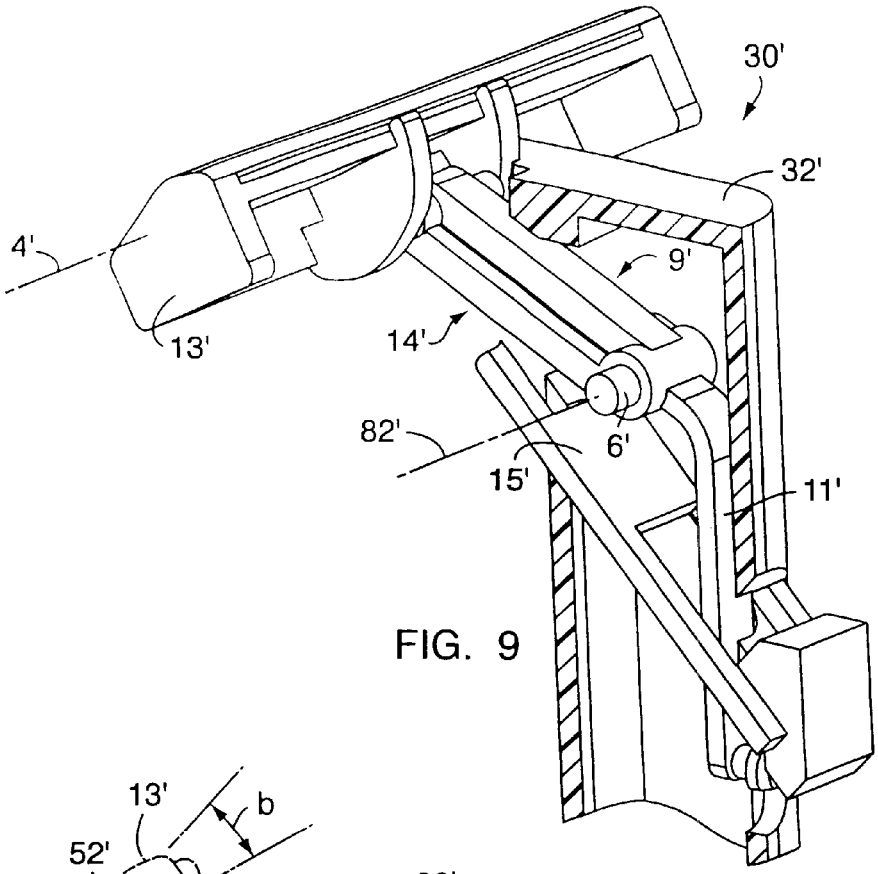
FIG. 9—A view similar to FIG. 5 of a shaving razor comprising another embodiment of the invention.
Figure 10:
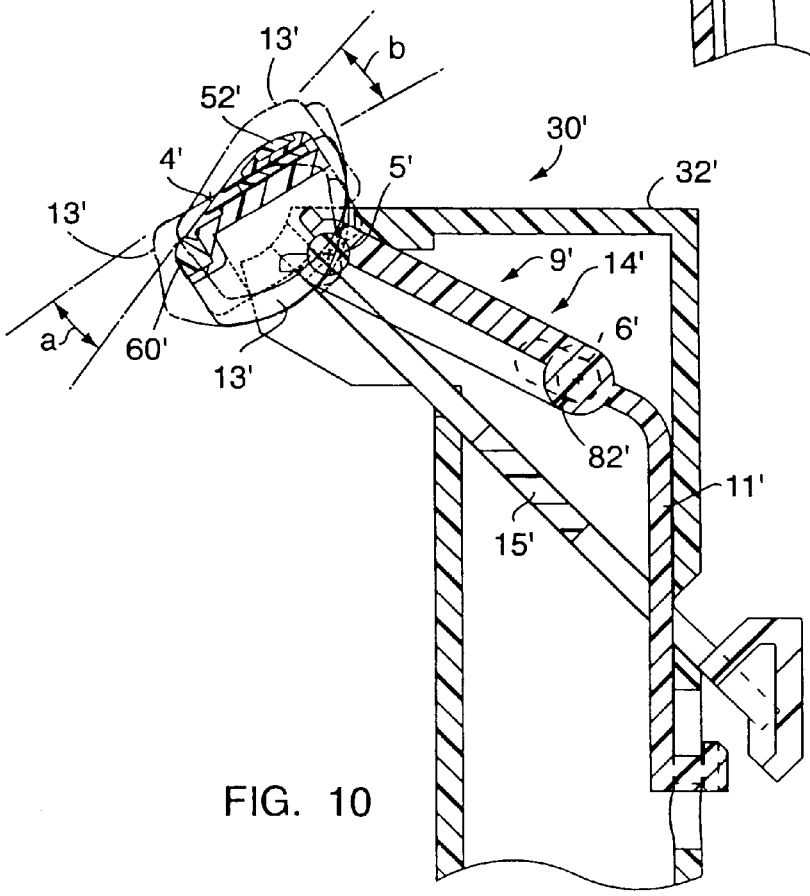
FIG. 10—A vertical sectional view of the shaving razor of FIG. 9.

Referring to FIGS. 9 and 10, the shaving razor 30' there shown includes a spring element 14' so configured and related to the main component 32' that, when a blade cartridge 13' is attached to the forward end of the spring arm 9', the arm 9' has a neutral position at which the cartridge 13' is held in a corresponding neutral position about the pivot axis 4' as shown by the solid lines of FIG. 10. The neutral positions of the arm 9' and blade cartridge 13', as shown by the solid lines of FIG. 10, are the positions assumed by the arm 9' and cartridge 13' when no shaving or other extraneous forces are applied to the cartridge tending to rotate it at about the axis 4'. However, when shaving forces are applied to the cartridge 13', the cartridge is able to rotate in either the clockwise or the counterclockwise direction about the pivot axis 4', as shown by the broken lines of FIG. 10, with the spring element 14' resiliently resisting such movement of the cartridge in either direction away from its neutral position. In FIG. 10 the angle a represents the range of permitted movement of the cartridge in the clockwise direction away from the neutral position of the cartridge, and the angle b represents the permitted range of movement of the cartridge in the counterclockwise direction away from the neutral position of the cartridge. Preferably the permitted range of movement of the cartridge in each of the clockwise and counterclockwise directions about the pivot axis 4' and away from the neutral position of the cartridge is about 20°.

It should also be noted from FIGS. 9 and 10 that the spring element 14' and the main component 32' are so designed that the spring arm 9' and cartridge 13', are free to move substantial amounts relative to the main component 32' in either direction away from their neutral positions. Additionally, if desired, suitable stops (not shown) may be provided on the main component 32' for engagement with either the spring arm 9' or with the cartridge 13' to positively limit the degree to which the cartridge 13' is able to rotate in one or both directions away from its neutral position.

An arrangement such as that of FIGS. 9 and 10 wherein the blade carrier or cartridge is able to rotate in either direction against spring biasing force away from a neutral position is preferably used in cases where the pivot axis 4' for movement of the blade receiver or cartridge relative to the main component is located somewhere near the middle of a line tangent to the cartridge guard 60' and to the shaving aid 52' or other cap skin-engaging element of the blade carrier or cartridge, as is the case, with the razor 32'. When the pivot axis for movement of the blade receiver or cartridge relative to the main component is located in the vicinity of the guard or the leading blade cutting edge or in front of the guard, it is preferable for the blade receiver or blade cartridge to pivot in only one direction away from a given limit position as in the embodiment of FIGS. 1–8.

In the drawings, the cartridges 13 and 13' are shown by way of example to each have two blades, but the invention is not broadly limited to any particular number of blades per cartridge or blade carrier, and instead in the broader aspects of the invention, each cartridge or blade carrier may have only one blade or any larger number of blades, up to five or more, as may be practical. Also, the pickup element of the blade cartridge or blade receiver in the broader aspects of the invention need not be in the shape of a bar but can be of some other shape, for example a ball-shape, with the outer end of the spring arm 9 being suitably formed for connecting cooperation with such other shape of pickup element.

What is claimed is:

1. A shaving razor comprising:

a blade carrier carrying at least one blade having an elongated cutting edge, a main component including an upper portion for holding the blade carrier, the blade carrier below the blade having at least one bearing surface circularly arcuate about an axis parallel to the cutting edge, the upper portion of the main component having an arcuate bearing surface complementary to the arcuate bearing surface of the blade carrier and engageable with the arcuate bearing surface of the blade carrier so that said blade carrier is pivotal relative to said upper portion of the main component about said axis as a result of said arcuate bearing surfaces sliding relative to one another, and wherein said arcuate bearing surface of the main component is concave and faces generally outwardly and upwardly relative to the main component, and a spring mechanism working between the blade carrier and the main component urging the blade carrier toward the main component to hold the arcuate bearing surfaces in engagement with one another and also biasing the blade carrier about said axis relative to the main component to a given position of the blade carrier relative to the main component so as to resiliently resist movement of the blade carrier about said axis in a direction away from said given position.

2. A shaving razor as defined in claim 1, wherein:

said one arcuate bearing surface of the blade carrier is one of a plurality of such arcuate bearing surfaces which plurality of arcuate surfaces are spaced from one another along the length of said axis, and said one arcuate bearing surface of the upper portion of the main component is one of a plurality of such arcuate bearing surfaces which plurality of arcuate bearing surfaces are engageable respectively with the plurality of arcuate bearing surfaces of the blade carrier.

3. A shaving razor as defined in claim 2, wherein:

said blade carrier has two side walls located respectively adjacent said two arcuate surfaces of the blade carrier, and said upper portion of the main component has two side wall surfaces adjacent the two arcuate surfaces of the upper portion of the main component, which side wall surfaces of the blade carrier and side wall surfaces of the upper portion of the main component are engageable with one another to restrict lateral movement of said blade carrier relative to said upper portion of the main component along the length of said axis.

4. A shaving razor as defined in claim 3, wherein:

said upper portion of said main component has two arcuate relief surfaces located respectively adjacent said two arcuate bearing surfaces of said upper portion, said arcuate relief surfaces being circularly arcuate about said axis and having radii of curvature slightly larger than the radii of curvature of said arcuate bearing surfaces of said upper portion.

5. A shaving razor as defined in claim 1, wherein:

said at least one blade is a first blade of said blade carrier, and said blade carrier also carries a second blade located slightly above said first blade and having an elongated cutting edge, the elongated cutting edge of said second blade being located rearwardly of the cutting edge of said first blade.

6. A shaving razor as defined in claim 1, wherein:

said blade and blade carrier are part of a blade cartridge releasably insertable into and removable from the upper portion of the main component.

7. A shaving razor as defined in claim 6, wherein:

said one arcuate bearing surface of the blade carrier is one of two such arcuate bearing surfaces which two arcuate bearing surfaces are spaced from one another along the length of said axis, and said one arcuate bearing surface of the upper portion of the main component is one of two such arcuate bearing surfaces and which are engageable with the two arcuate bearing surfaces of the blade carrier.

8. A shaving razor as defined in claim 7, wherein:

said blade carrier of the blade cartridge includes a pickup element forming part of the spring mechanism and located between the two arcuate bearing surfaces of the blade carrier and having a longitudinal axis parallel to the cutting edge.

9. A shaving razor as defined in claim 8, wherein:

the upper portion of the main component has a pickup part forming part of the spring mechanism and having opposed spring fingers for snap-fittingly receiving the pickup element of the blade cartridge.

10. A shaving razor as defined in claim 9, wherein:

said pickup part is part of a spring element forming part of the spring mechanism, said spring element being carried and supported by the main component so that when said pickup element is held by the pickup part, the pickup part pulls the arcuate bearing surfaces of the blade cartridge into engagement with the arcuate bearing surfaces of the upper portion of the main component and resiliently resists movement of the cartridge relative to the upper portion of the main component about said pivot axis away from said given position of the cartridge relative to the upper portion.

11. A shaving razor as defined in claim 10, wherein:

said given position of the cartridge relative to the upper portion is a counterclockwise limit position of said cartridge about said pivot axis and the spring element acts to resiliently resist movement of the cartridge relative to the upper portion about the pivot axis in the clockwise direction away from said counterclockwise limit position.

12. A shaving razor as defined in claim 10, wherein:

said given position of the cartridge relative to the upper portion is a neutral position of said cartridge about said pivot axis and the spring element acts to resiliently resist movement of the cartridge relative to the upper portion about the pivot axis in both the clockwise and counterclockwise directions away from said neutral position.

13. A shaving razor as defined in claim 10, wherein:

the upper portion of the main component is hollow with front and rear walls and two laterally spaced side walls defining a hollow space, the spring element has a central portion located in the hollow space of the upper portion, the central portion has two laterally oppositely extending stubs with a common horizontal axis received respectively in two slots in the two side walls permitting said center portion of the spring element to rotate relative to the upper portion of the main component about the common axis of the stubs and to move generally forwardly and rearwardly relative to the upper portion along the length of the slots, the spring element has a first arm extending generally forwardly from the central portion and having a forward end carrying the pickup part, the spring element also has a second arm extending from the central portion and having an outer end portion slidably engaged with a stop surface of the main component, said second arm being made of a spring material and having a neutral unstressed condition and said second arm being held by the stop surface in a stressed condition away from said neutral condition so that said second arm biases the center portion of the spring element to a rearward position at which the arcuate surfaces of the blade cartridge are held firmly against the arcuate bearing surfaces of the main component.

14. A shaving razor as defined in claim 13, wherein:

said second arm of the spring element also biases the center portion and first arm clockwise relative to the axis of the stubs to a given position of the forward end of the first arm so that said first arm and second arm together resiliently resist movement of said forward end of the first arm away from said given position of the forward end of the first arm.

15. A shaving razor as defined in claim 13, wherein:

said second arm of the spring element also biases the center portion and first arm to a neutral position of the forward end of the first arm and said first arm and second arm together resiliently resist movement of the forward end of the first arm in both the clockwise and counterclockwise directions about the axis of the stubs away from the neutral position.

16. A shaving razor as defined in claim 15, wherein:

said pickup element is a pickup bar having an axis extending parallel to the cutting edge of the blade, and said pivot axis of the cartridge relative to the main component, said axis of the pickup bar and said axis of the stubs are parallel to one another and substantially intersect a common straight line.

17. A shaving razor as defined in claim 13, wherein:

the outer end of the second arm has a stem slidably received in a slot of the main component.

18. A shaving razor as defined in claim 11, wherein:

said main component includes an elongated ejector element extending through the upper portion of the main component and supported by said upper portion for linear sliding movement relative to the upper portion, said ejector element being inclined upwardly and forwardly relative to the upper portion and having a rear end portion located rearwardly of the upper portion, and said ejector element having a forward end which, when the ejector element is moved forwardly from a rearward position by a user's thumb or finger pressing the rear end forwardly, is engageable with the blade cartridge to eject the blade cartridge from the main component.

19. A replaceable blade cartridge for a shaving razor, said cartridge comprising:

a blade carrier carrying at least one blade having an elongated cutting edge, and said blade carrier below the blade having at least two bearing surfaces circularly arcuate about an axis parallel to the cutting edge, said two bearing surfaces being spaced from one another along the length of the cutting edge, and a pickup bar located between the two arcuate bearing surfaces and having a second axis parallel to the cutting edge and spaced from the first axis.

20. A replaceable blade cartridge as defined in claim 19, wherein:

said arcuate bearing surfaces are convex and arcuate about a first axis extending parallel to the cutting edge, and said axis of the pickup bar is located below the cutting edge.

21. A replaceable blade cartridge as defined in claim 20, wherein:

said blade carrier includes two lateral side walls located respectively adjacent said two arcuate bearing surfaces.

22. A replaceable blade cartridge as defined in claim 21, wherein:

said blade carrier includes two arcuate relief surfaces located respectively adjacent said two arcuate bearing surfaces, said relief surfaces being arcuate about said first axis and having radii of curvature slightly larger than the radii of curvature of said bearing arcuate surfaces.

23. A replaceable blade cartridge as defined in claim 19, wherein:

said at least one blade is a first blade, and said cartridge includes a second blade located above said first blade and having a cutting edge located parallel to and rearwardly of said cutting edge of the first blade.

* * * * *